US006880468B2

(12) United States Patent
Hellman

(10) Patent No.: US 6,880,468 B2
(45) Date of Patent: Apr. 19, 2005

(54) ARTILLERY SHELL AND METHOD OF FIRING THEREOF

(75) Inventor: Ulf Hellman, Örnsköldsvik (SE)

(73) Assignee: Bofors Defence AB, Karlskoga (SE)

( * ) Notice: Subject to any disclaimer, the term of this patent is extended or adjusted under 35 U.S.C. 154(b) by 0 days.

(21) Appl. No.: 10/474,906

(22) PCT Filed: Apr. 11, 2002

(86) PCT No.: PCT/SE02/00715

§ 371 (c)(1),
(2), (4) Date: Mar. 15, 2004

(87) PCT Pub. No.: WO02/086411

PCT Pub. Date: Oct. 31, 2002

(65) Prior Publication Data

US 2004/0149157 A1 Aug. 5, 2004

(30) Foreign Application Priority Data

Apr. 19, 2001 (SE) ..... 0101366

(51) Int. Cl.[7] ..... F42B 14/02
(52) U.S. Cl. ..... 102/524
(58) Field of Search ..... 102/524–528; D22/115, 116

(56) References Cited

U.S. PATENT DOCUMENTS 2,348,675 A * 5/1944 Dodge ..... 102/528
2,856,856 A * 10/1958 Michael ..... 102/526
3,431,815 A * 3/1969 Kaufmann, Jr. ..... 89/1.1
4,109,582 A 8/1978 Haep et al.
4,552,071 A * 11/1985 Horais et al. ..... 102/527
4,884,508 A * 12/1989 Kruse et al. ..... 102/524
H000794 H * 7/1990 Telmo et al. ..... 102/527
5,164,540 A 11/1992 Chiarelli et al.
5,862,011 A * 1/1999 Sega et al. ..... 360/98.01
6,237,497 B1 * 5/2001 Altenau et al. ..... 102/524

FOREIGN PATENT DOCUMENTS

EP 0905473 3/1999

OTHER PUBLICATIONS

International Search Report Application No. PCT/SE 02/00715, dated Jul. 17, 2002.

* cited by examiner

*Primary Examiner*—Teri Pham Luu
*Assistant Examiner*—Bret Hayes
(74) *Attorney, Agent, or Firm*—Connolly Bove Lodge & Hutz LLP; Larry J. Hume

(57) ABSTRACT

The present invention relates to a method and a device for improving—at least in part—the external ballistieds of primarily the type of artillery shells (1) that are fin-stabilised in their trajectory towards the target and thus have a slipping plastic driving band (6) which, during firing of the said shell from a designated barrel, constitutes the shell's direct contact with the inside of the barrel. The problem that it is the function of the present invention to resolve is that the slipping plastic driving band (6) normally detaches immediately outside the muzzle of the barrel used for firing, thereby leaving an open groove (4) that causes distrubing turbulence which is detrimental to the flight of the said shell. The solution to the problem herein proposed is based on a ring-shaped spring-loaded device (5) arranged between the driving band (6) and the bottom of the driving band groove (4) and which device is held pressed against the bottom of the said driving band groove as long as the driving band (6) is in position but as soon as it detaches from the said driving band groove the said device deploys to re-assume a predetermined original shape which completely fills the driving band groove (4) up to and level with the outer surface of the shell (1).

20 Claims, 2 Drawing Sheets

ARTILLERY SHELL AND METHOD OF FIRING THEREOF

Figure 1:
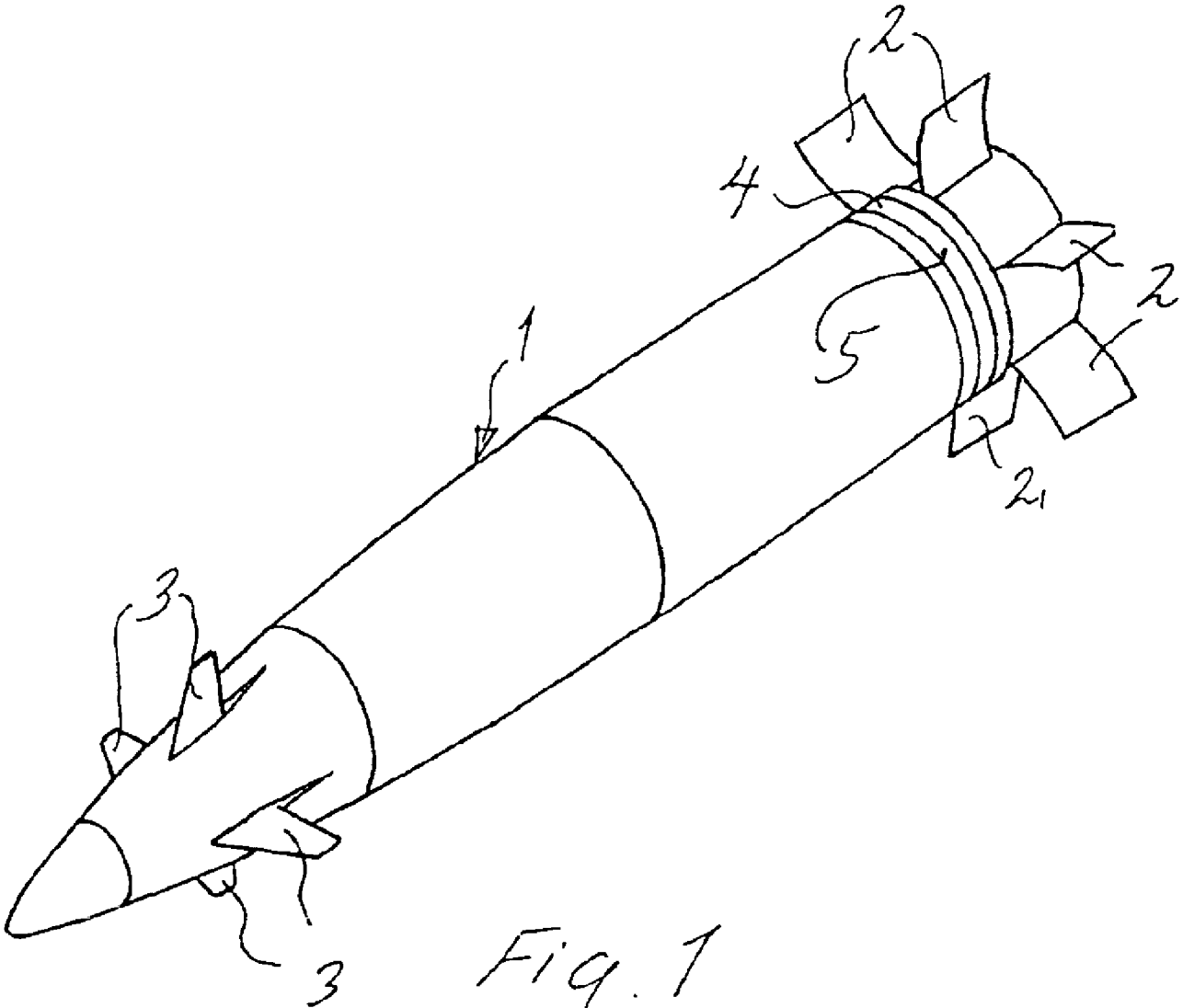

The present invention relates to a method and a device for improving—at least in part—the external ballistics of primarily the type of artillery shells that are fin-stabilised in their trajectory towards the target and thus have a slipping plastic driving band which, during firing from a designated barrel, constitutes the shell's direct contact with the inside of the barrel.

The slipping plastic driving band means that this type of shell exits the barrel with a very low rate of spin or no spin at all, which obviously facilitates the fin stabilisation of the shell which shall be effected immediately it exits the muzzle by means of deployment of a plurality of fins previously retracted and integrated in the shell. The plastic driving band is usually so worn out from its severe treatment during the shell's passage through the barrel that the remnants of the driving band break away from their seat around the shell as the shell exits the muzzle of the gun in which it is fired. As soon as the shell has left the muzzle the well-defined groove in which the slipping plastic driving band was originally seated thus becomes revealed in the otherwise smooth external surface close to the rear face of the shell.

No one has previously paid any attention to the empty driving band groove, but now when every means available is being employed in attempts to increase the range of tube-firing artillery it has been ascertained that the empty, sharply-defined driving band groove causes turbulence in the surrounding atmosphere that cannot be ignored as it has a retarding, disturbing effect on the shell during its trajectory to the target.

The objective of the present invention is to resolve this problem by offering a method and a device which, without interfering with the functioning of the slipping driving band, fills the driving band groove as soon as the remnants of the driving band have detached from the said groove, thus enabling elimination of the otherwise disturbing turbulence around the driving band groove in an effective way.

The fundamental principle for the method as claimed in the present invention is an arrangement between the bottom of the driving band groove and the slipping driving band incorporating a ring-shaped, spring-loaded device that is initially compressed and which, as long as the driving band is in position, is held pressed against the bottom of the driving band groove by the driving band but which device, as soon as the driving band or remnants of the driving band have detached from the driving band groove, deploys and re-assumes a predetermined original shape that completely fills the driving band groove to be level with the outer surface of the shell.

This fundamental principle provides space for a device comprising an open first part made of a springback material and arranged in the driving band groove, and which first part is the same width as the said groove and has a length equivalent to the circumference of the shell at a position level with the driving band groove and when in deployed state forms a circular ring with an open gap between its two ends and comprises a plurality of identical filler elements made similarly of springback material mounted in the said first part and directed in deployed state at the bottom of the driving band groove, which filler elements are so designed that they can be pressed in against the inside of the said first part at the same time as the first part can be retracted against the bottom of the driving band groove with the ends of the said first part overlapping while allowing space outside the said first part in the driving band groove for the actual driving band.

According to a preferred variant of the present invention the filler elements are designed such that in deployed state they extend from each attachment point in the said first part in a slight arc in towards the bottom of the driving band groove, which they reach in a mainly tangential direction. This variant provides good centring of the first device so that in deployed state it gives a precise filling out of the driving band groove.

If all the filler elements are also given such a length and are attached to the inside of the said first device with such a distance between the attachment points that there is adequate space to accommodate them between each other when the said device is retracted around the bottom of the driving band groove one achieves a filler device which, when in retracted state, has a thickness that in principle is only equivalent to double the thickness of the material of which the first ring-shaped device and filler elements are fabricated, and for this purpose it is appropriate to use a titanium-based sheet metal with good shape memory.

Finally, it can also be noted that the combined latent spring force, when the first part of the device is retracted around the bottom of the driving band groove and its filler elements are retracted against the said first part, does not need to be greater than that the said first part is held in place by the driving band arranged on top as long as the latter has not come into use.

The present invention is defined in the subsequent Patent Claims, and is now described in only slightly more detail with reference to some relevant figures.

In these figures

Figure 3:
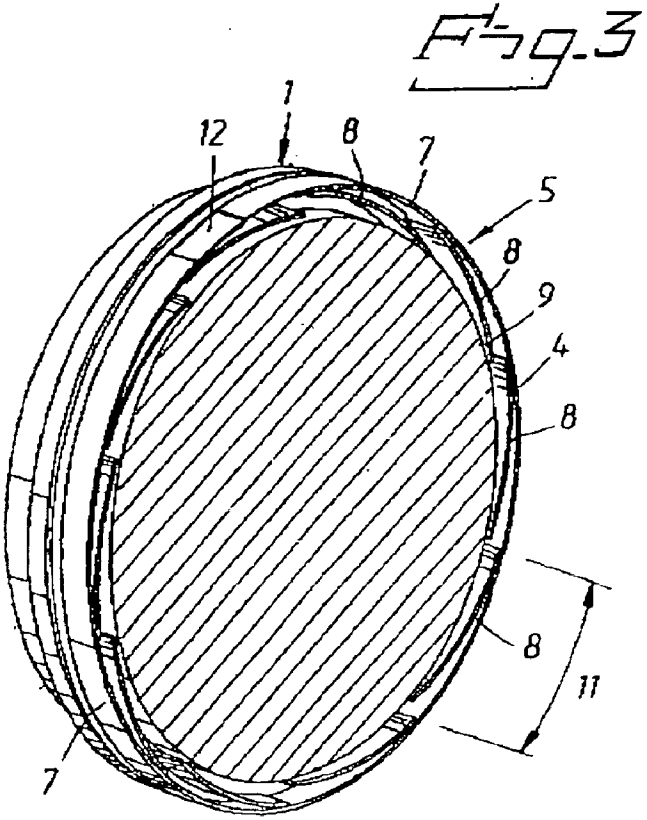
Figure 2:
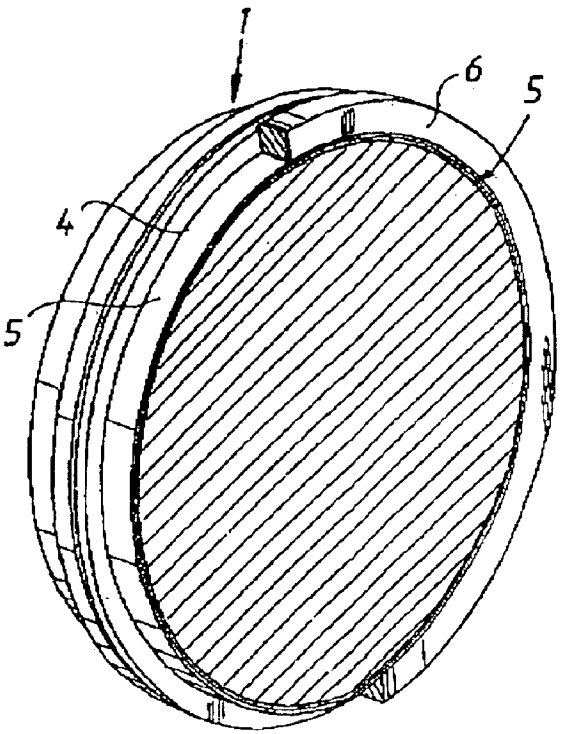

FIG. 1 depicts an oblique projection of a fin-stabilised shell equipped with a filling, as claimed in the present invention, of the shell's driving band groove after detachment of the slipping driving band, and FIG. 2 is a section through the shell at a position level with the driving band groove with half the driving band illustrated in its original position, while FIG. 3 depicts the same section as FIG. 2 but with the driving band groove filler as claimed in the present invention fully deployed.

The shell 1 depicted in FIG. 1 is fin-stabilised with six aft fins 2 and is guided in its trajectory by four canards 3. Near the deployed aft fins there is a driving band groove 4 which, in the mode illustrated in FIG. 1, is filled by the device 5 claimed in the present invention.

FIG. 2 shows a section through the shell 1 level with the driving band groove 4, in part of which a driving band 6 is illustrated. There is a driving band groove filler 5 compressed under the driving band 6 against the bottom of the driving band groove 4. FIG. 3 depicts the driving band groove filler 5 in deployed state in which it completely fills the driving band groove after the driving band has detached from the groove. As shown in FIG. 3 the driving band groove filler 5 consists of an outer ring 7 of springback material of the same width as the driving band groove and with preferably at least the same length as the circumference of the shell 1 at a position level with the driving band groove 4. A plurality of springback filler elements 8 are arranged inside the outer ring 7. When deployed the said elements extend in a slight arc from each of their attachment points down to a tangency of the bottom of the driving band groove 4 herein designated 9. The distance 11 between the attachment point in the outer ring 7 of each filler element 8 and the attachment point of the next filler element is such that the length of each filler element in compressed state has adequate space between its own attachment point and the attachment point of the next filler element. The design of the filler elements 8 is such that the outer ring 7 in deployed state is supported concentrically around the bottom of the driving band groove 9 precisely level with the outer surface of the shell where the outer ring 7 forms a continuation that spans the full width of the driving band groove. As shown in FIG. 3 the outer ring 7 is somewhat shorter than the fill circumference of the shell, while a bridging element 12 attached to one end of the said outer ring covers the gap between the opposite ends of the said outer ring. The gap between the said ends is equal to the difference between the circumference of the shell and the circumference around the bottom of the driving band groove.

I claim:

1. A method for firing artillery shells, comprising:

providing an artillery shell comprising:

a driving band groove extending around a circumference of the shell, spring means for filling the driving band groove disposed in a compressed state within the driving band groove;

an outer ring disposed over the spring means and extending around the driving band groove; and a driving band disposed over the outer ring;

firing the artillery shell from a barrel; and deploying the spring means as the artillery shell exits a muzzle of the barrel so that the spring means fills the driving band groove, wherein the spring means remains in the driving band groove after the artillery shell leaves the barrel.

2. The method of claim 1, wherein the artillery shell comprises:

a bridging clement attached to the outer ring.

3. The method of claim 1, wherein the artillery shell comprises:

a plurality of fins disposed at a rear of the artillery shell.

4. The method of claim 1, wherein:

deploying the spring means deploys the outer ring to a position level with an outer surface of the shell; and the spring means deploys to fill the entire groove.

5. The method of claim 1, wherein:

the driving band detaches from the groove as the artillery shell exits the muzzle.

6. A method for firing artillery shells, comprising:

providing an artillery shell comprising:

a driving band groove extending around a circumference of the shell;

a plurality of filler elements disposed in a compressed state against a bottom of the driving band groove;

an outer ring disposed over the plurality of filler elements and extending around the driving band groove; and a driving band disposed over the outer ring;

firing the artillery shell from a barrel; and deploying the filler elements as the artillery shell exits a muzzle of the barrel so that the plurality of filler elements fill the driving band groove, wherein the plurality of filler elements remain in the driving band groove after the artillery shell leaves the barrel.

7. The method of claim 6, wherein the artillery shell comprises:

a bridging element attached to the outer ring.

8. The method of claim 6, wherein the artillery shell comprises:

a plurality of fins disposed at a rear of the artillery shell.

9. The method of claim 6, wherein:

deploying the filler elements deploys the outer ring to a position level with an outer surface of the shell.

10. The method of claim 6, wherein:

the filler elements are attached to the outer ring.

11. The method of claim 6, wherein:

the driving band detaches from the groove as the artillery shell exits the muzzle.

12. An artillery shell, comprising:

a driving band groove at a rear of the shell;

a driving band disposed within the driving band groove;

a driving band groove filler disposed within the driving band groove and comprising a plurality of springback filler elements; and an outer ring disposed between the driving band and the driving band groove filler.

13. The artillery shell of claim 12, wherein the springback filler elements are initially held in a compressed state by the driving band.

14. The artillery shell of claim 13, wherein the springback filler elements are held in the compressed state against a bottom of the driving band groove.

15. The artillery shell of claim 13, wherein the outer ring comprises a bridging element.

16. The artillery shell of claim 13, wherein the springback filler elements are made from metal and are mounted at a plurality of attachment points.

17. A method of firing an artillery shell, comprising:

providing an artillery shell within a barrel, the shell having a driving band groove, a driving band disposed within the driving band groove, a driving band groove filler disposed within the driving band groove, and an outer ring disposed between the driving band and the driving band groove filler, wherein the driving band contacts the inside of the barrel; and firing the shell from the barrel, wherein the driving band detaches from the driving band groove after firing from the barrel, end the driving band groove filler deploys to fill the driving band groove.

18. The method of claim 17, wherein the driving band groove filler comprises a plurality of springback filler elements.

19. The method of claim 18, wherein the springback filler elements are made from metal aid are initially held in a compressed state by the driving band against a bottom of the driving band groove.

20. The method of claim 19, wherein the outer ring comprises a bridging element, the outer ring deploying with the springback filler elements, and the bridging element covering an open gap in the outer ring as the springback filler elements deploy.

* * * * *